US007064285B2

(12) United States Patent
Ichimaru

(10) Patent No.: US 7,064,285 B2
(45) Date of Patent: Jun. 20, 2006

(54) COVER OPENING AND CLOSING MECHANISM

(75) Inventor: Takahide Ichimaru, Chigasaki (JP)

(73) Assignee: NIFCO Inc., Kanagawa (JP)

( * ) Notice: Subject to any disclaimer, the term of this patent is extended or adjusted under 35 U.S.C. 154(b) by 0 days.

(21) Appl. No.: 11/055,618

(22) Filed: Feb. 11, 2005

(65) Prior Publication Data

US 2005/0183940 A1 Aug. 25, 2005

(30) Foreign Application Priority Data

Feb. 20, 2004 (JP) ..... 2004-045312

(51) Int. Cl.
*H01H 1/64* (2006.01)

(52) U.S. Cl. ..... 200/293; 74/608; 49/503

(58) Field of Classification Search ..... 200/520, 200/523–526, 293; 74/99 R, 608, 609, 612, 74/616, 606 R; 49/394, 503
See application file for complete search history.

(56) References Cited

U.S. PATENT DOCUMENTS 6,857,675 B1 * 2/2005 Kurachi et al. ..... 296/37.12
2003/0080131 A1 * 5/2003 Fukuo ..... 220/264

FOREIGN PATENT DOCUMENTS

| | | |
|---|---|---|
| DE | 101 30 055 | 2/2003 |
| GB | 2 381 290 | 4/2003 |
| JP | 05-38983 | 2/1993 |
| JP | 11278514 | * 10/1999 |
| JP | 2002-362237 | 1/2002 |
| JP | 2002-362237 | 12/2002 |

* cited by examiner

*Primary Examiner*—Enad Elvin
*Assistant Examiner*—M. Fishman
(74) *Attorney, Agent, or Firm*—Manabu Kanesaka

(57) ABSTRACT

A cover opening and closing mechanism switches a cover body on a corresponding surface of a main body between a closed position for closing the corresponding surface and an open position for opening the same. The cover opening and closing mechanism includes a forcing device for always urging the cover body toward the closed position; a push button; a switching device having a cam facing the button, an acceleration gear engaging a gear part provided on the cover body, and a striker; and a latch device for locking the striker in the open position of the cover body and releasing the lock when the button is pushed. The switching device switches the cover body from the closed position to the open position against a force of the forcing device.

8 Claims, 9 Drawing Sheets

COVER OPENING AND CLOSING MECHANISM

BACKGROUND OF THE INVENTION AND RELATED ART STATEMENT

The present invention relates to a cover opening and closing mechanism for switching a cover body between an open position and a closed position on a corresponding surface of a main body (for example, an opening or an operating panel of switches and the like).

A cover opening and closing mechanism used in a vehicle console or the like, as disclosed in Japanese Patent Publication (Kokai) No. 2003-129742, usually forces a cover body toward a direction of an open position by forcing means, and switches the cover body from the open position to a closed position against a force of the forcing means. The cover body stays in the closed position by locking a striker on a side of the cover body with latch means on a side of the main body in the closed position. In this case, when the cover body is divided into two parts, an idle gear or the like is interposed between the cover bodies for synchronously switching each cover body between the open position and the closed position. Also, the latch means releases the lock on the striker by pressing an operating button and enables switching of the cover body from the closed position to the open position. Hereunder, these types are called a former mechanism.

Also, FIGS. 9(*a*) and 9(*b*) show a cover opening and closing mechanism disclosed in Patent Document 1. The cover opening and closing mechanism synchronously switches divided two cover bodies (door bodies) 14 and 16 between an open position and a closed position, and comprises an open button 18 and a close button 20, Z-shaped arms 58 and 64, a rotating body 32, as a large gear, and an invertible-type spring 50 with one end 50A engaging a coupling groove 44 of a rotating body 32 and the other end 50B supported by a shaft 52 on a side of the main body. The open button 18 is linked to one end 58A of the arm 58 by means of a shaft 54, and the close button 20 is linked to one end 64A of the arm 64 by means of a shaft 60. Symbol 30 is a small gear on a side of the cover body 16 for engaging the rotating body 32. Symbol 38 is a small gear provided on a side surface opposite to a side where the arm 58 is disposed inside the cover body 14. The small gear 38 engages a small gear on a corresponding surface of the cover body 16 by means of an idle gear.

In the mechanism, when the open button 18 is pushed in a state that the cover bodies 14 and 16 are in the closed position as shown in FIG. 9(*a*), the arm 58 rotates around a shaft 66 fitted in a hole 68. A lower end front end part 58C of the arm 58 presses the linking part 50A of the spring 50, and the arm 58 moves along the coupling groove 44 of the rotating body 32 from the left side end part 44A (stable point) toward the right side end part 44B. Also, the linking part 50A of the spring 50 passes a middle point and moves toward the right side end part 44B of the coupling groove 44. Accordingly, the rotating body 32 receives a force for rotating the rotating body 32 in the counterclockwise direction as a partial force of the spring 50. Therefore, even if a hand is removed from the open button 18, the rotating body 32 rotates the cover bodies 14 and 16 toward the open direction by the force of the spring 50. On the other hand, when the close button 20 is pushed in a state such that the cover bodies 14 and 16 are in the open position as shown in FIG. 9(*b*), the arm 64 rotates around the shaft 66, and the lower end front end part 64C of the arm 64 moves the linking part 50A of the spring 50 along the coupling groove 44 from the right side end part 44B (stable point) toward the left side end part 44A. Also, when the linking part 50A of the spring 50 passes the middle point and moves toward the end part 44A of the coupling groove 44, the rotating body 32 receives a force for rotating the rotating body 32 in the clockwise direction as a partial force of the spring 50. Therefore, even if the hand is removed from the open button 20, the rotating body 32 rotates the covers 14 and 16 toward the closed direction by the force of the spring 50.

Patent Document 1: Japanese Patent Publication (Kokai) 2002-362237

In the former mechanism described above, the lock of the striker on the latch means is released by a push operation of a button or the like, and the cover body is automatically switched from the closed position to the open position by the force of the forcing means. However, in this mechanism, when the cover switches from the open position to the closed position, it is necessary to move the cover body toward the closed position while pushing against the force of the forcing means with a hand, finger, or the like, thereby lacking high quality. Also, in an automobile and the like, a structure becomes complex because it is necessary to assuredly prevent an action in which the latch means releases the lock on the striker due to a load applied upon a collision and the cover body is switched to the open direction unexpectedly.

Also, in the mechanism shown in FIGS. 9(*a*) and 9(*b*), first, there is a risk that a driver or passenger pushes a wrong button as the open button and the close button are arranged next to each other. There also is a risk that the cover body is automatically switched to the open position when the button is mistakenly pushed, thereby impairing the safety. Also, it is more preferable from placement and design considerations to provide a single operating button rather than double.

An object of the present invention is to solve the problems described above with a relatively simple structure while maintaining high quality. Further, it is possible to assuredly prevent the risk that the cover body is switched to the open position unexpectedly by an impact load upon a collision accident or the like, and it is easy to improve quality and expand application.

Further objects and advantages of the invention will be apparent from the following description of the invention.

SUMMARY OF THE INVENTION

According to a first aspect of the present invention, a cover opening and closing mechanism for switching a cover body on a corresponding surface of a main body between a closed position for closing the corresponding surface and an open position for opening the same comprises: forcing means for always forcing the cover body toward the closed position; a single push operation button provided on the main body or a border member for the main body; switching means with a cam facing the button, an acceleration gear engaging a gear part provided on the cover body, and a striker for switching the cover body from the closed position to the open position against the force of the forcing means by means of the cam and acceleration gear through a push operation of the button; and latch means for locking the striker in the open position of the cover body and releasing the lock through the push operation of the button.

According to a second aspect of the invention, a cover opening and closing mechanism for synchronously switching each of divided two cover bodies on a corresponding surface of a main body between a closed position for closing the corresponding surface and an open position for opening the same comprises: forcing means for always forcing at least one of the two cover bodies toward the closed position; a single push operation button provided on the main body or a border member for the main body; switching means with a cam facing the button, an acceleration gear engaging a gear part provided on the one cover body, and a striker for switching the one cover body from the closed position to the open position against the force of the forcing means by means of the cam and acceleration gear through a push operation of the button; power transmitting means for switching the other cover body between the open position and the closed position in linkage with the one cover body; and latch means for locking the striker in the open position of the one cover body and releasing the lock through the push operation of said button.

Each of the cover opening and closing mechanisms described above has common characteristics that the cover body is always forced toward the closed position by the forcing means, the cover body is switched from the closed position to the open position by means of the switching means upon the push operation of the button, the cover body is kept in the open state by locking the striker on the latch means, the lock is released upon the push operation of the button, and the cover body is switched to the closed position by the force of the forcing means. The second aspect differs from the first aspect in the point that the two cover bodies are synchronously switched between the open position and the closed position. In contrast with the first aspect, the power transmitting means is added. An operational characteristic is that, in contrast with the structure in which an open button and a close button are provided as disclosed in Patent Document 1, because the operating button is singular, there is no risk that the button is mistakenly pushed. In addition, it is possible to reduce a placement space of the button by half and improve an external appearance and design characteristics. Also, the cover body is always forced toward the closed position, so that there is no risk such as being switched unexpectedly from the closed position to the open position by malfunction of the latch means and the safety being impaired as in a conventional mechanism.

The invention may be modified as shown in the following third to sixth aspects.

First, it is structured such that the power transmitting means has a pair of idle gears interposed between the cover bodies. Also, the forcing means is a coil spring, and two ends of the spring are respectively fixed on the one cover body and on the idle gear of the pair of idle gears engaging the other cover body (the third aspect). In this case, for example, even when the forcing means is the coil spring, it is easy to adjust and change a spring pressure or force in a multilevel by changing fixing locations of the two ends of the spring.

Second, it is structured such that, in the first or second aspect, the switching means has a force amplifying gear mechanism interposed between the cam and the acceleration gear (the fourth aspect). In this case, a pushing force of the button is transmitted to the cam, acceleration gear, and cover body, or the pushing force of the button is transmitted to the cam, acceleration gear, one cover body, power transmitting means, and other cover body. It is possible to reduce the pushing force of the button by interposing the gear mechanism.

Third, in the first or second aspect, the latch means is a push-push locking mechanism for locking the striker by a first push operation of the button and releasing the lock by a subsequent push operation in the same direction of the button (the fifth aspect). It is affirmatively specified that the latch means can be substituted by a well-known push-push locking mechanism.

Fourth, it is structured such that, in the first or second aspect, a damper means is provided for damping an opening and closing speed of the cover body (the sixth aspect). In this case, the cover body is damped by the damper means, thereby having good operating characteristics and eliminating sudden movement.

The cover opening and closing mechanism of the present invention has the following advantages.

In the first and second aspects, the operating button is singular compared with a conventional structure having an open button and a close button, so that there is no risk that the button is mistakenly pushed, the placement space of the button is reduced by half, and the external appearance and design characteristics are improved. At the same time, because the cover body is always forced toward the closed position, the cover body is not switched to the open position even if the lock is released by malfunction of the latch means. Accordingly, the problem of eliminating the malfunction due to a collision load required for conventional latch means is solved, and consequently it is possible to make the latch means simple and reduce cost.

In the third aspect, the forcing means is provided between the one cover body and the idle gear engaging the other cover body. Accordingly, for example, even with the same spring member, by just changing the fixing positions of the two ends of the spring, the rotational force of the cover body, and the like, can be adjusted to any value.

In the fourth aspect, the gear mechanism is disposed between the cam and the acceleration gear. Accordingly, it is possible to adjust the pushing force of the operating button below an excessive level and a pushing amount thereof, thereby improving operability of the operating button.

In the fifth aspect, the push-push locking mechanism is provided as the latch means, thereby improving the switching characteristics of opening and closing the cover body. Also, it is possible to eliminate exposed members as much as possible, thereby improving the external appearance.

In the sixth aspect, the damper means is provided for damping the opening and closing speed of the cover body, thereby obtaining high quality.

DETAILED DESCRIPTION OF PREFERRED EMBODIMENTS

Figure 1A:
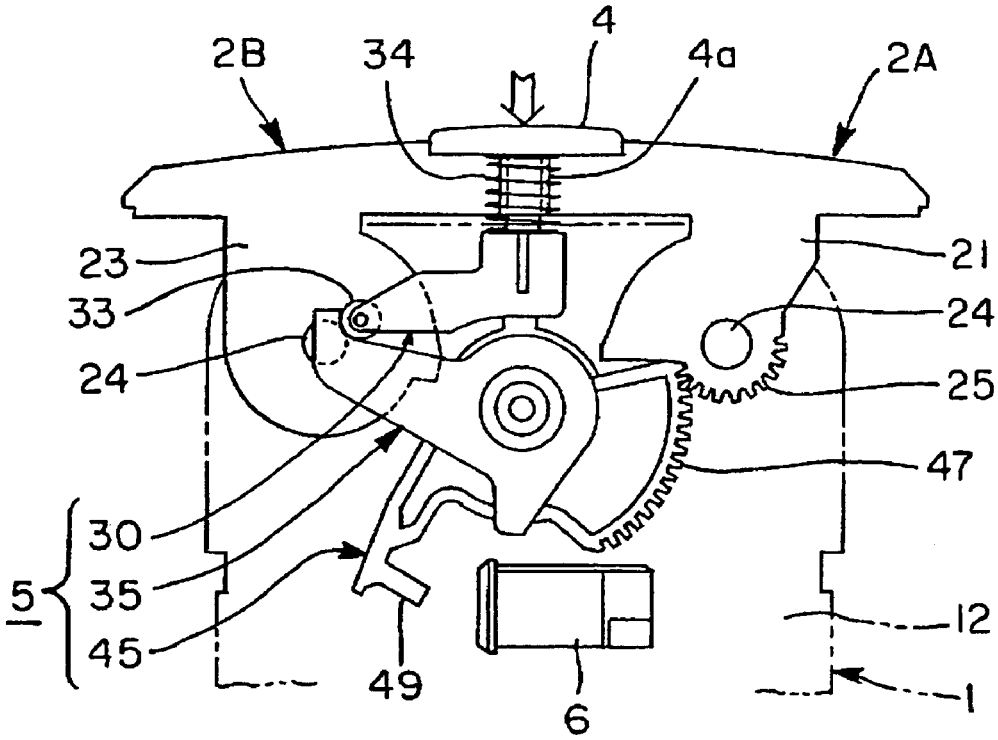
FIGS. 1(*a*) and 1(*b*) are schematic views showing a cover opening and closing mechanism according an embodiment of the present invention viewed from one side of a main body in a front-to-back direction.
Figure 1B:
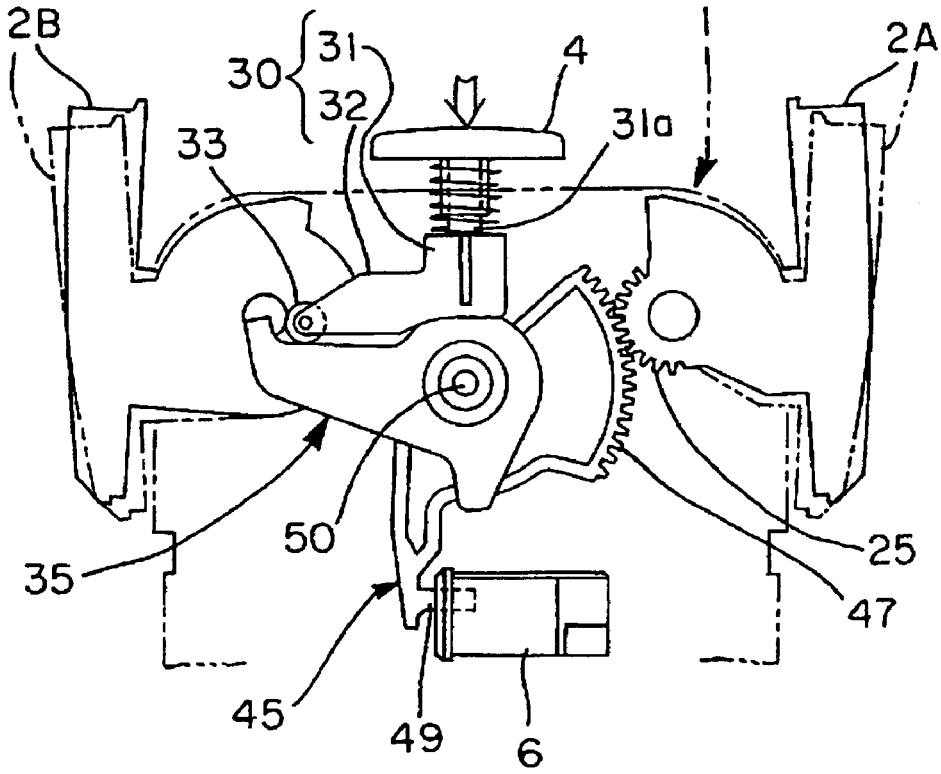
Figure 4:
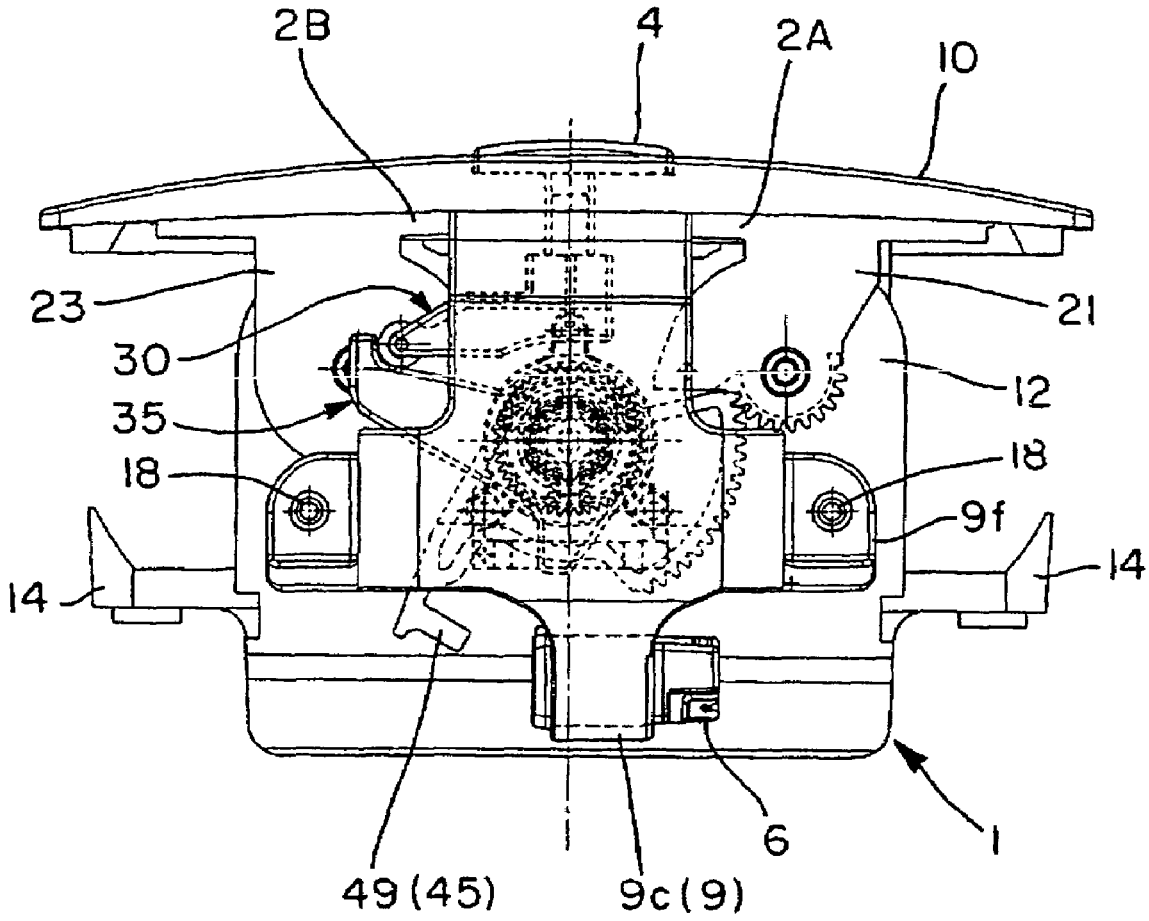
FIG. 4 is a rear view of the apparatus at one side in a front-to-back direction.
Figure 5:
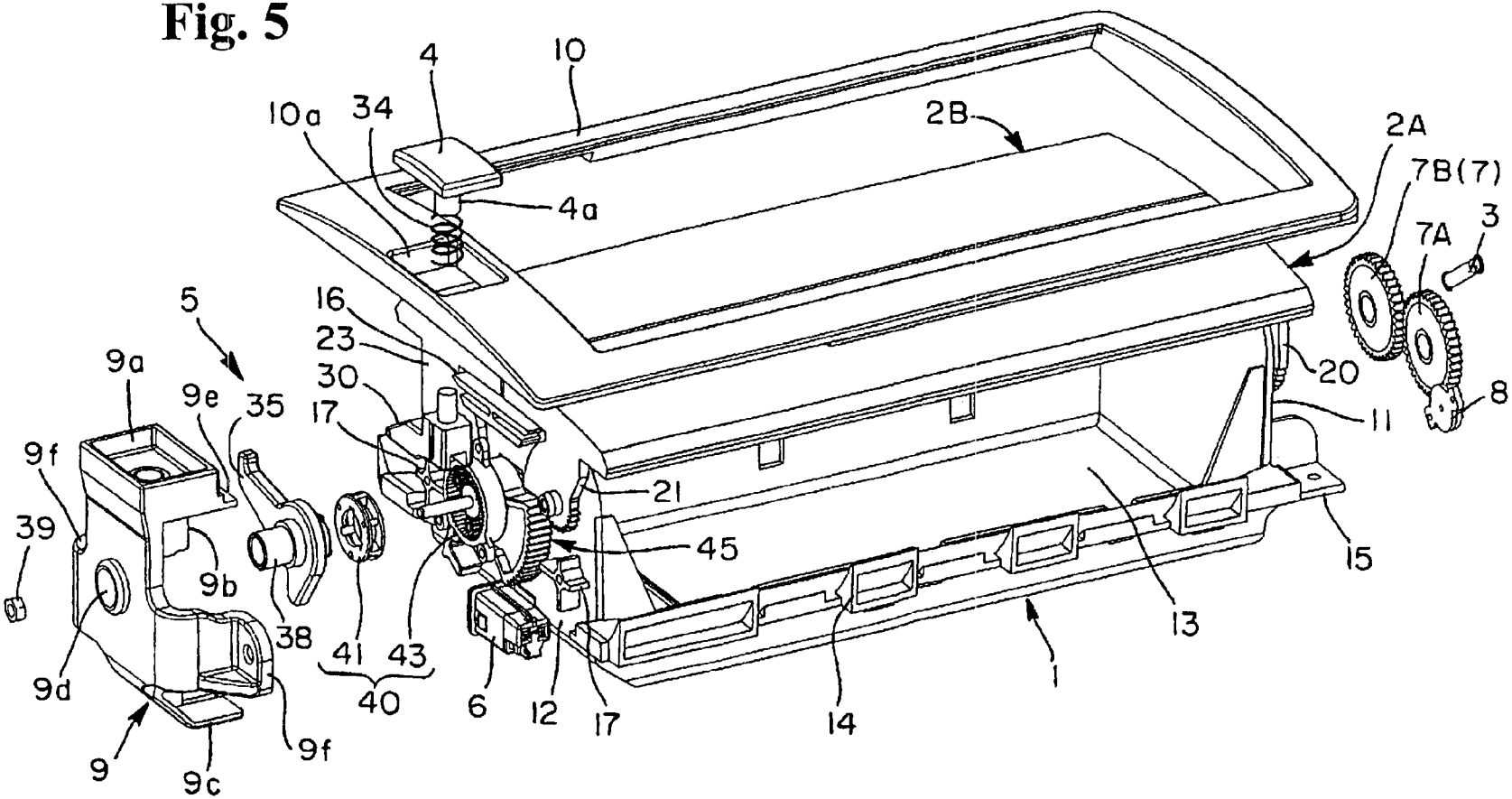
FIG. 5 is an exploded view showing the cover opening and closing mechanism applied to the apparatus.
Figure 6A:
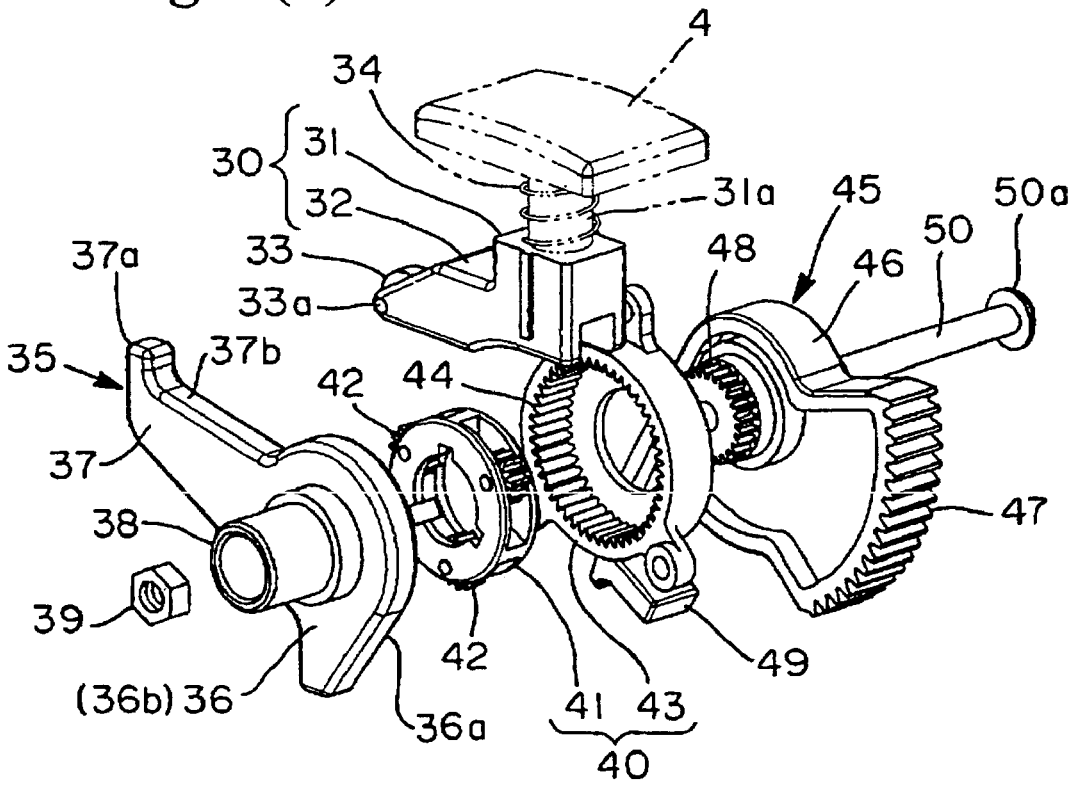
FIGS. 6(*a*) and 6(*b*) are views showing essential parts of switching means constituting the cover opening and closing mechanism.
Figure 6B:
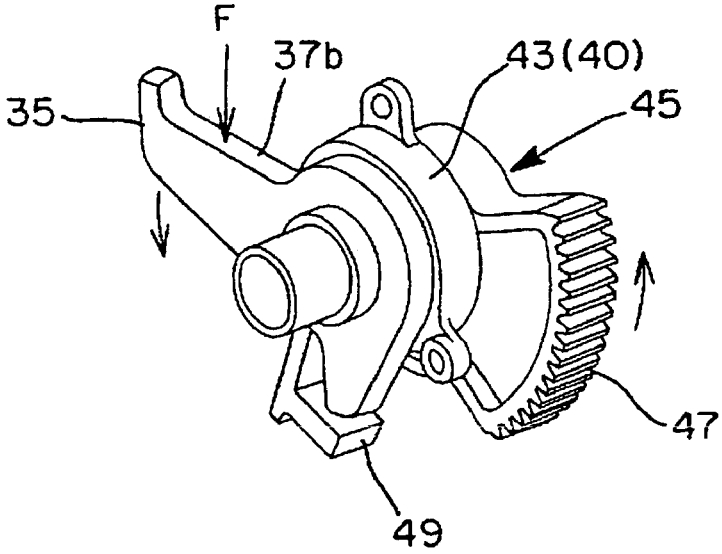
Figure 7A:
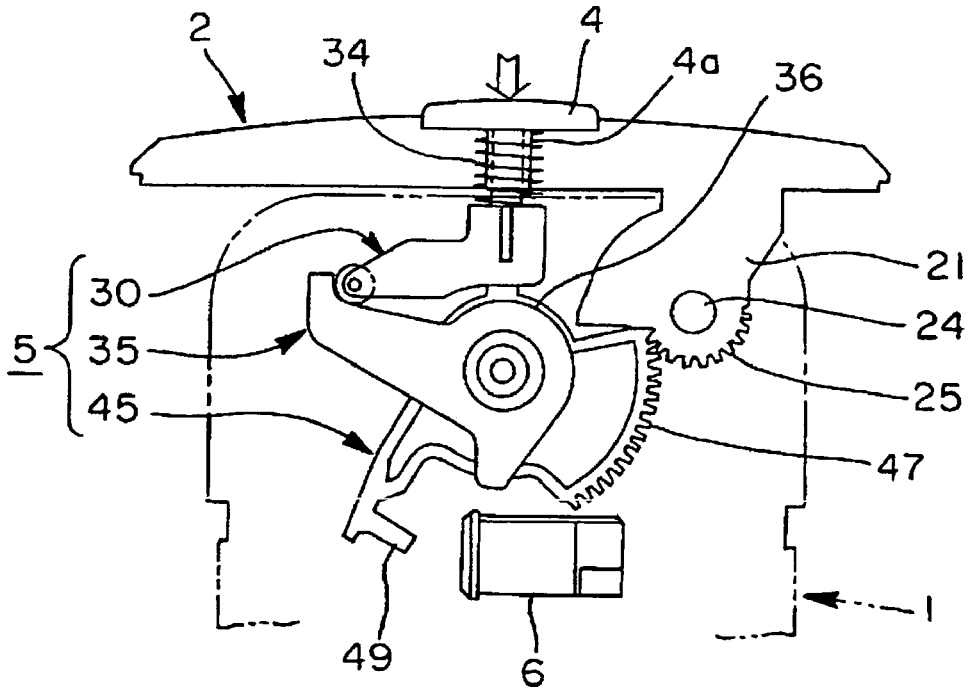
FIGS. 7(*a*) and 7(*b*) are schematic views showing a modified example of the embodiment in correspondence with FIGS. 1(*a*) and 1(*b*)
Figure 7B:
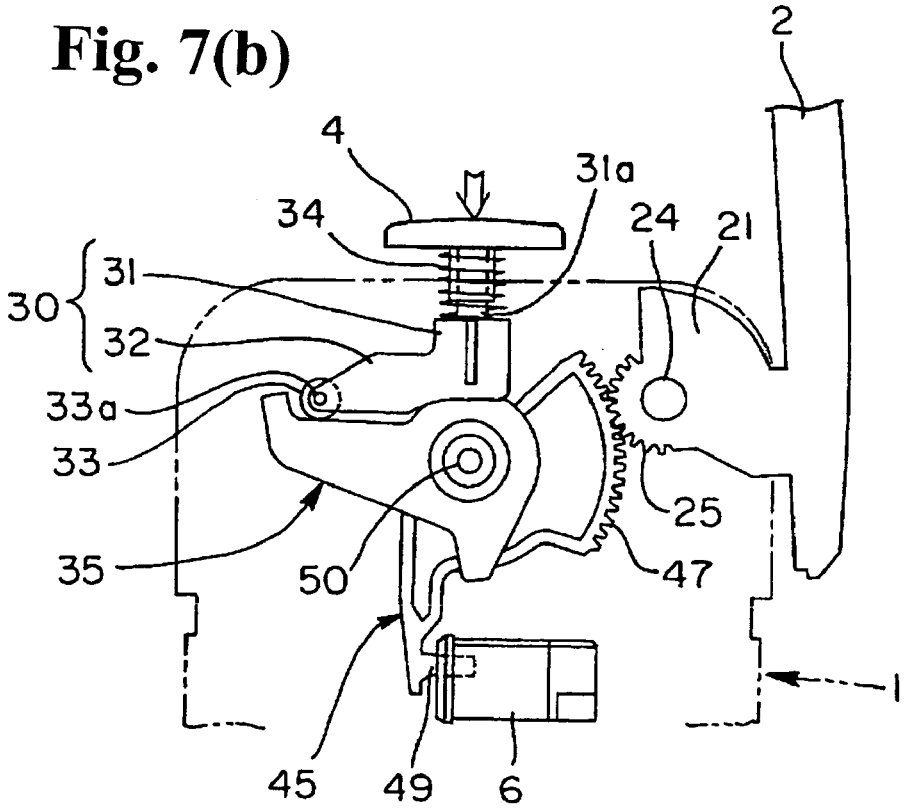
Figure 8A:
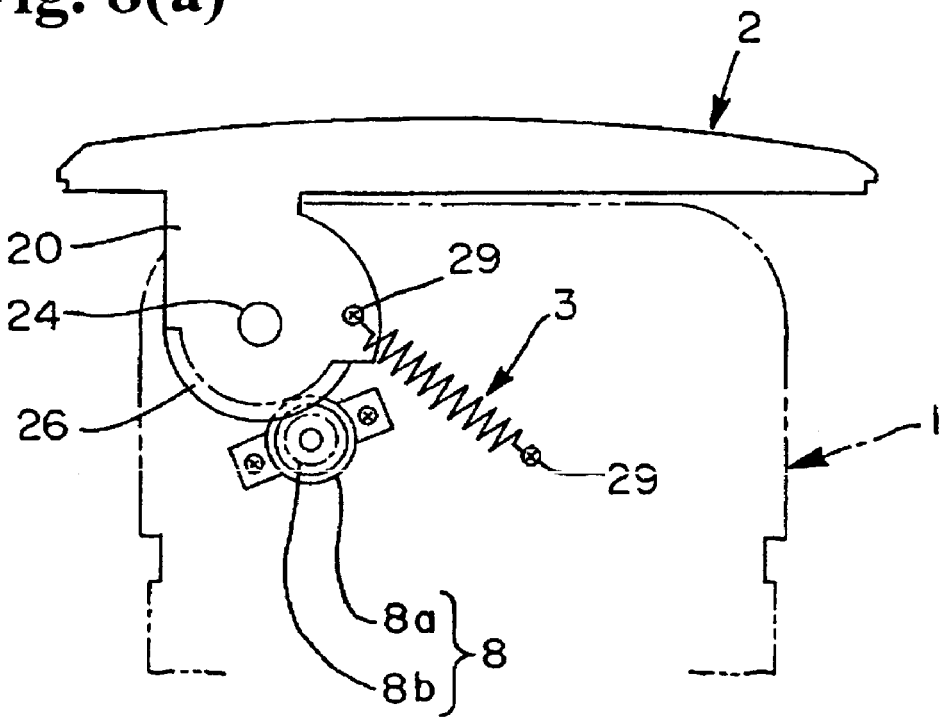
FIGS. 8(*a*) and 8(*b*) are schematic views showing the modified example shown in FIGS. 7(*a*) and 7(*b*) in correspondence with FIGS. 2(*a*) and 2(*b*)
Figure 8B:
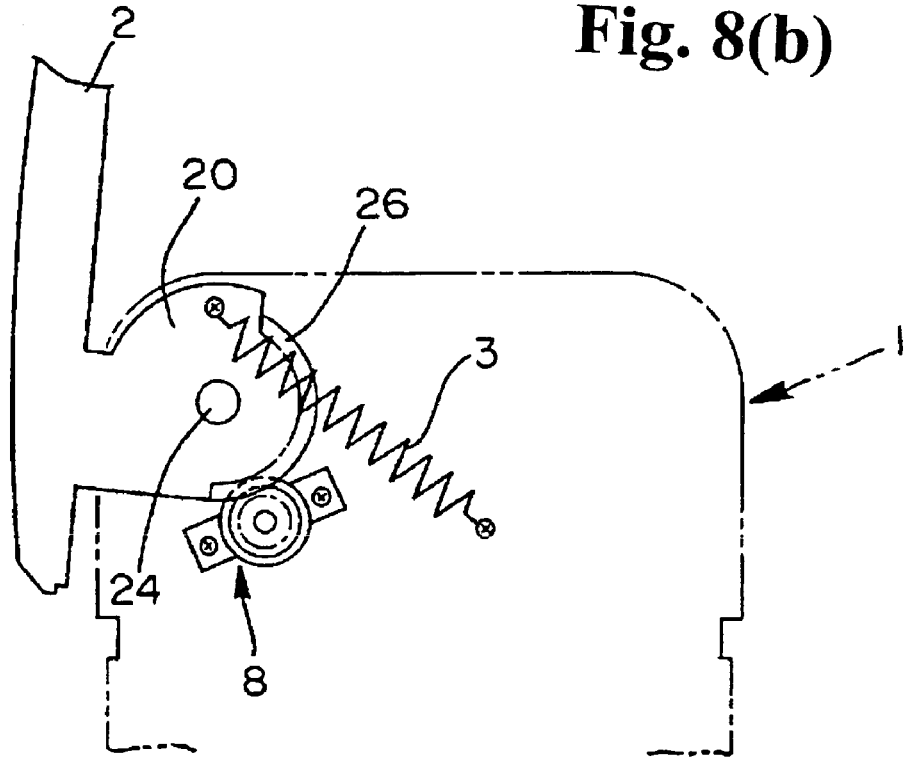
Figure 9A:
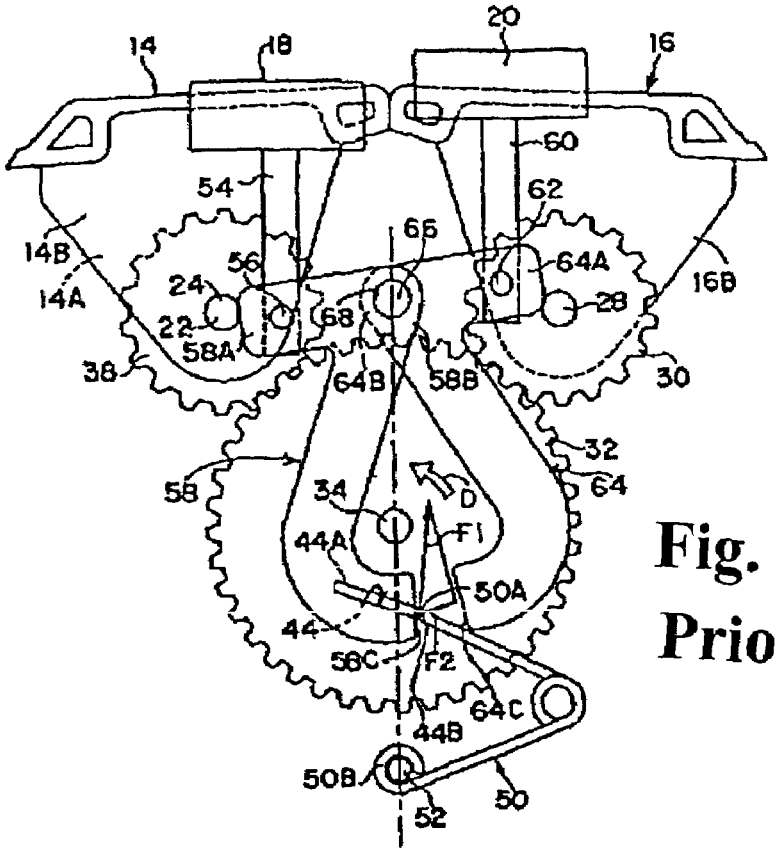
Fig. 9(a) Prior Art
FIGS. 9(*a*) and 9(*b*) are schematic views showing a conventional cover opening and closing mechanism.
Figure 9B:
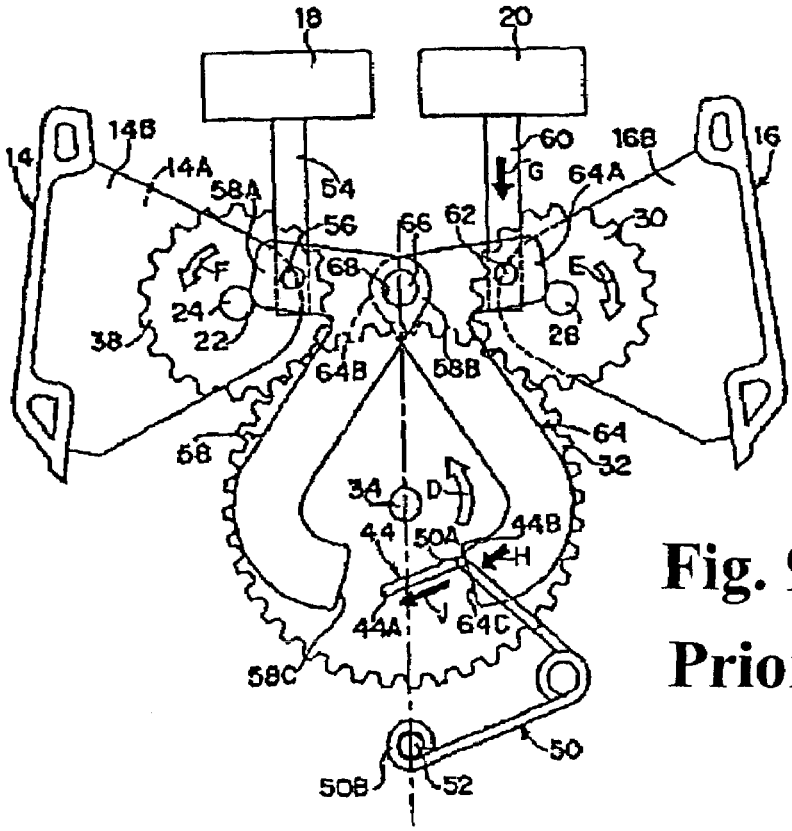
Fig. 9(b) Prior Art

Hereunder, embodiments of the present invention will be explained with reference to the accompanying drawings. FIGS. 1(*a*) and 1(*b*) and FIGS. 2(*a*) and 2(*b*) are schematic views showing a cover opening and closing mechanism according an embodiment of the present invention. FIGS. 3(*a*) and 3(*b*) are schematic views showing an applied example of the cover opening and closing mechanism viewed in a front-to-back direction. FIG. 4 is a rear view or back view. FIG. 5 is an exploded view showing a relationship among parts. FIGS. 6(*a*) and 6(*b*) are views showing the switching means. FIGS. 7(*a*) and 7(*b*) and FIGS. 8(*a*) and 8(*b*) are schematic views showing the cover opening and closing mechanism applied to a single cover structure in correspondence with FIGS. 1(*a*) and 1(*b*) and FIGS. 2(*a*) and 2(*b*), respectively. In the following explanation, the embodiments are described in detail after describing an outline of the invention.

(Outline) The cover opening and closing mechanism of the present invention rotates and switches a cover body 2 or cover bodies 2A and 2B on a corresponding part (an opening, or an operating panel of switches and the like) of a main body 1 between a closed position for closing the corresponding part and an open position for opening the same. The cover opening and closing mechanism is used in a configuration having the divided cover bodies 2A and 2B as shown in FIGS. 1(*a*) and 1(*b*) to FIGS. 6(*a*) and 6(*b*) (divided cover mode), and a configuration consisting of a single cover body 2 as shown in FIGS. 7(*a*) and 7(*b*) and FIGS. 8(*a*) and 8(*b*) (single cover mode). In the present invention, the cover body is used in the same sense as a door, cover, and the like, and the main body is used in the same sense as a housing, case, and the like of a machine or device.

In the single mode, one cover body 2 is rotated and switched between the closed position and the open position. An essential structure comprises: a coil spring 3 as forcing means which always forces the cover body 2, which is pivotally supported on the main body 1, toward the direction of the closed position; a single push operation button 4 which is provided on the main body 1 or a border member 10 for the main body; switching means 5 which has a cam 35 facing the button 4, an acceleration gear 45 being linked to the cam 35 and engaging a gear part 25 provided on the cover body 2, and a striker 49 provided on the acceleration gear 45, and switches the cover body 2 from the closed position to the open position against the force of the coil spring 3 by means of the cam 35 and the acceleration gear 45 by push operation of the button 4; and latch means 6 which locks the striker 49 in the open position of the cover body 2 and enables release of the lock by push operation of the button 4. Accordingly, the cover body 2 is forced to be held in the closed position (or closed state) by a strength corresponding to the spring pressure of the coil spring 3 as shown in FIG. 7(*a*) and FIG. 8(*a*). In the case of switching the cover body 2 to the open position (or open state), when the button 4 is pushed, the cover body 2 is rotated against the force of the coil spring 3 by the switching means 5 to the open position in which the opening of the main body 1 is almost completely open as shown in FIG. 7(*b*) and FIG. 8(*b*). At the same time, the striker 49 is engaged (locked) on the latch means 6 attached on the side of the main body 1 along the movement of the acceleration gear 45. Accordingly, the cover body 2 is held in the open position against the force of the coil spring 3. Also, the lock is released when the button 4 is pushed in the same direction and the pushing force is released. Accordingly, the cover body 2 is again rotated and switched to the open position by the force of the coil spring 3.

On the other hand, in the divided cover mode, each of the two covers 2A and 2B are synchronously rotated and switched between the closed position and the open position. An essential structure comprises: a coil spring 3 as forcing means which always forces the cover bodies 2A and 2B, which are pivotally supported on the main body 1, toward the direction of the closed position; a single push operation button 4 which is provided on the main body 1 or a border member 10 for the main body; switching means 5 which has a cam 35 facing the button 4, an acceleration gear 45 being linked to the cam 35 and engaging a gear part 25 provided on said one cover body 2A, and a striker 49 provided on the acceleration gear 45, and switches the one cover body 2A from the closed position to the open position against the force of the coil spring 3 by means of the cam 35 and the acceleration gear 45 by push operation of the button 4; latch means 6 which locks the striker 49 in the open position of the cover body 2A and enables release of the lock by push operation of the button 4; and power transmitting means 7 which enables switching of the other cover body 2B between the open position and the closed position in linkage with the one cover body 2A. Accordingly, the cover bodies 2A and 2B are forced to be held in the closed position (or closed state) by a strength corresponding to the spring pressure of the coil spring 3 as shown in FIG. 1(*a*) and FIG. 2(*a*). In the case of switching the cover bodies 2A and 2B to the open position (or open state), when the button 4 is pushed, the one cover body 2A is rotated against the force of the coil spring 3 by the operation of the switching means 5 up to the open position in which the opening of the main body 1 is almost completely open as shown in FIG. 1(*b*) and FIG. 2(*b*). The rotational force of the cover body 2A is transmitted to the other cover body 2B by the power transmitting means 7, so that the cover body 2B is rotated up to the open position in synchronization. At the same time, the striker 49 is engaged (locked) on the latch means 6 attached on the side of the main body 1 along the movement of the acceleration gear 45. Accordingly, the cover bodies 2A and 2B are held in the open position against the force of the coil spring 3. Also, the lock is released when the button 4 is pushed in the same direction and the pushing force is released. Accordingly, the cover bodies 2A and 2B are again rotated and switched to the open position by the force of the coil spring 3.

In the divided cover mode, in contrast to the single cover mode, the cover opening and closing mechanism of the present invention has additionally power transmitting means 7 which enables switching of the other cover body 2B in linkage with the one cover body 2A. In the following embodiment, an explanation is based on the divided cover mode, and the explanation applies almost identically to the single cover mode as well, except the description of the power transmitting means 7. In FIGS. 7(*a*) and 7(*b*) and FIGS. 8(*a*) and 8(*b*), the same symbols are assigned to the operationally same members and parts in FIGS. 1(*a*) and 1(*b*) to FIGS. 6(*a*) and 6(*b*).

Similar to that disclosed in Patent Document 1, the cover opening and closing mechanism shown in FIGS. 1(*a*) and 1(*b*) to FIGS. 6(*a*) and 6(*b*) is provided as a mechanism for opening and closing an upper opening of a main body 1 which is housed inside a rectangular box-shaped housing part of an automobile console box. The mechanism comprises the coil spring 3, operating button 4, switching means 5, latch means 6, power transmitting means 7, and damper means 8. Also, the switching means 5 is constituted by a cam 35 which swings or rotates by means of a movable body 30 by push operation of the button 4, an acceleration gear 45 which is linked to the cam 35 by means of a force amplifying gear mechanism 40, and a striker 49 provided on a part of the acceleration gear 45, and the like.

Here, the main body 1 is defined by front and rear walls 11 and 12, a bottom wall 13, and reinforcing pieces and projecting walls 14 provided on both sides of the bottom wall 13 and the like, and the entire body is incorporated in a condition being housed inside a recess of a housing part similar to Patent Document 1. Also, the main body 1 has an attachment part 15 protruding from the front wall 11, bracket attachment parts 16 and 17 protruding from the rear wall 12, and a shaft pass-through hole not illustrated and provided in the rear wall 12 and the like. Symbol 10 is a border member which is installed on a perimeter of the recess of the housing part. On that border member 10, a recessed part 10*a* for placing a button 4 to move up and down freely is provided in a location corresponding to the rear wall 12 of the main body 1. Also, on the rear wall 12, a bracket 9 is attached corresponding to the button 4 placed in the recessed part 10*a* to be described later, and the movable body 30 and the switching means 5 are incorporated by using the bracket 9.

The cover bodies 2A and 2B are shaped to open and close the upper opening (the upper opening partitioned by a frame of the border member 10) of the main body 1 separately on the left and right, and respectively have supporting arm parts 20 and 21 or 22 and 23 on the front and rear parts in the longitudinal direction. Also, the front and rear arm parts 20 and 21 or 22 and 23 are pivotally supported by means of shafts 24 such as pins on the corresponding front and rear walls 11 and 12 of the main body 1, and the cover bodies 2A and 2B are switched to rotate between the closed position and the open position with the shafts 24 as fulcra. Also, on the front and rear arm parts 20 and 21 of the cover body 2A and on the front arm part 22 of the cover body 2B, tooth shapes, i.e., gear parts 25 or 26, are formed continuously on an arc-shaped perimeter part around the shaft 24. However, such gear part is not provided on the rear arm part 23 of the cover body 2B.

The cover bodies 2A and 2B, after respectively being pivotally supported by means of shafts 24 on the main body 1, are linked with the coil spring 3, power transmitting means 7, and damper means 8 on the side of the front wall 11 of the main body 1, and are linked with the operating button 4, switching means 5, and latch means 6 on the side of the rear wall 12 of the main body 1.

Figure 2A:
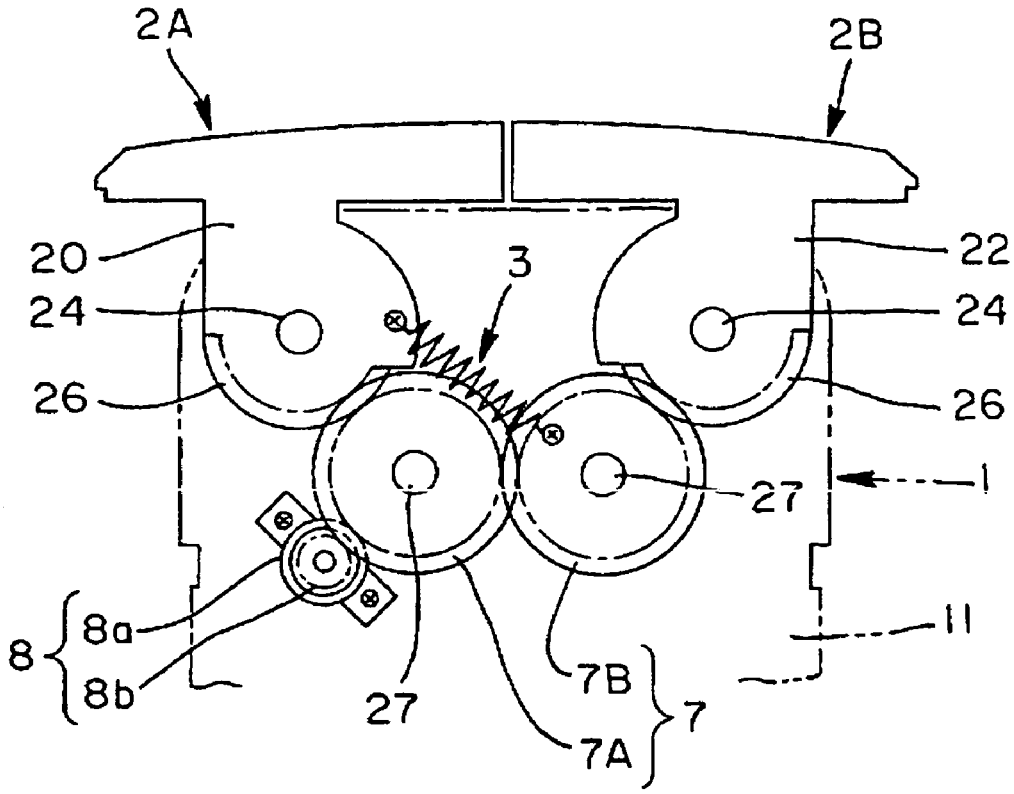
FIGS. 2(*a*) and 2(*b*) are schematic views showing the cover opening and closing mechanism in FIGS. 1(*a*) and 1(*b*) viewed from the other side of the main body in the front-to-back direction.
Figure 2B:
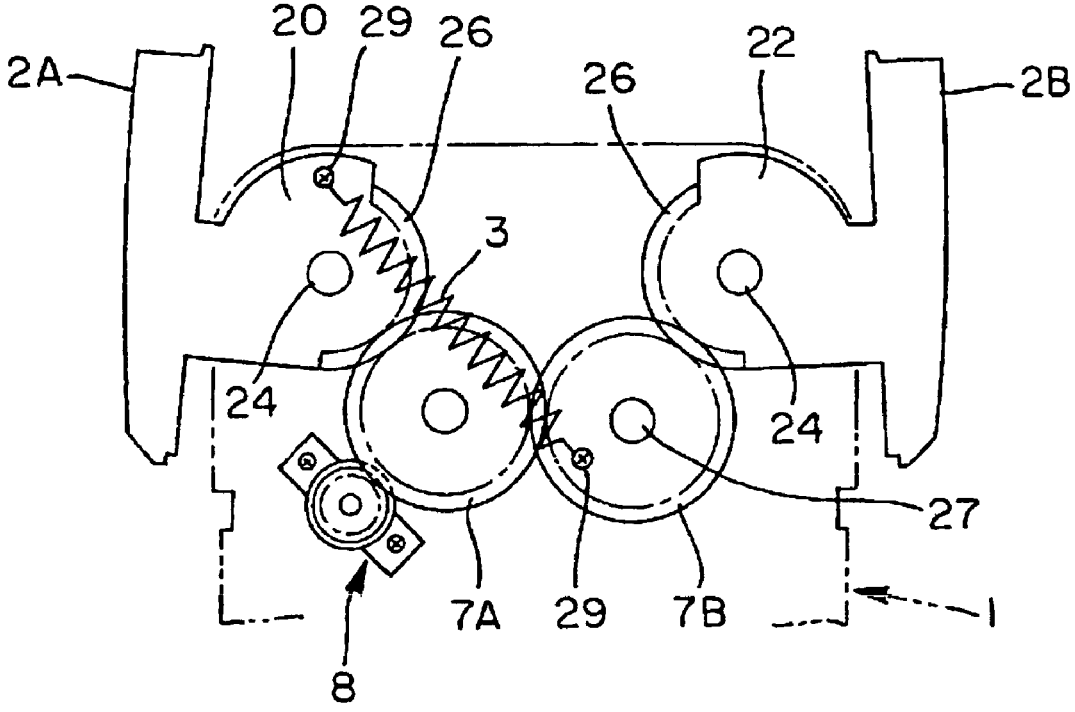
Figure 3A:
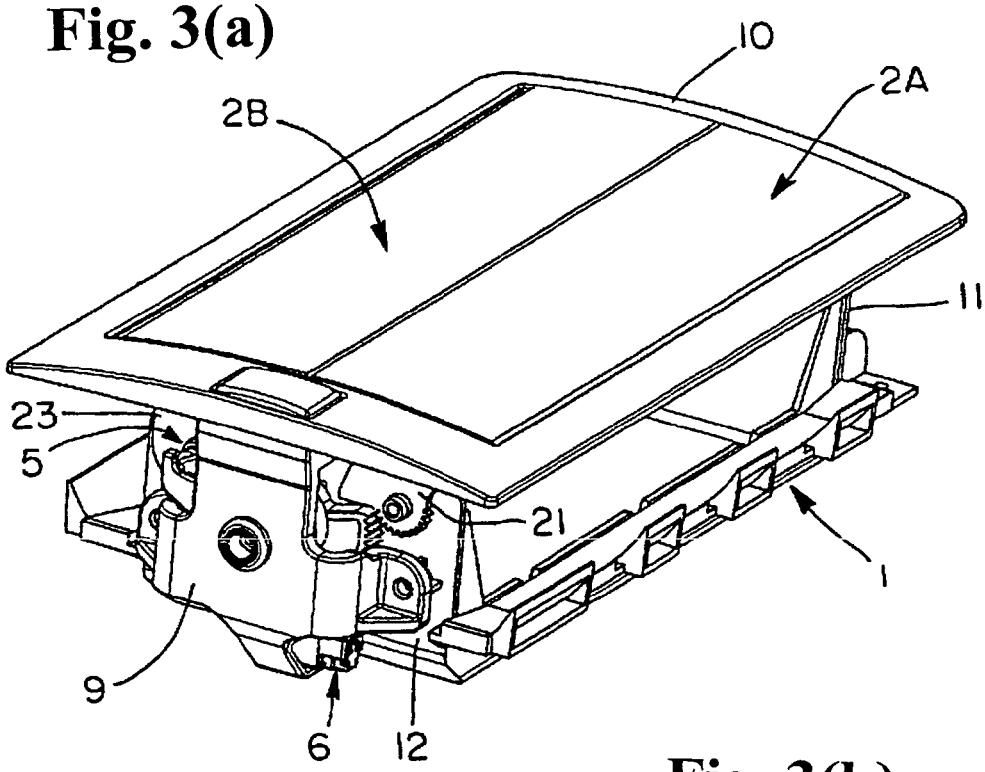
FIGS. 3(*a*) and 3(*b*) are schematic views showing essential parts of an apparatus with the cover opening and closing mechanism.
Figure 3B:
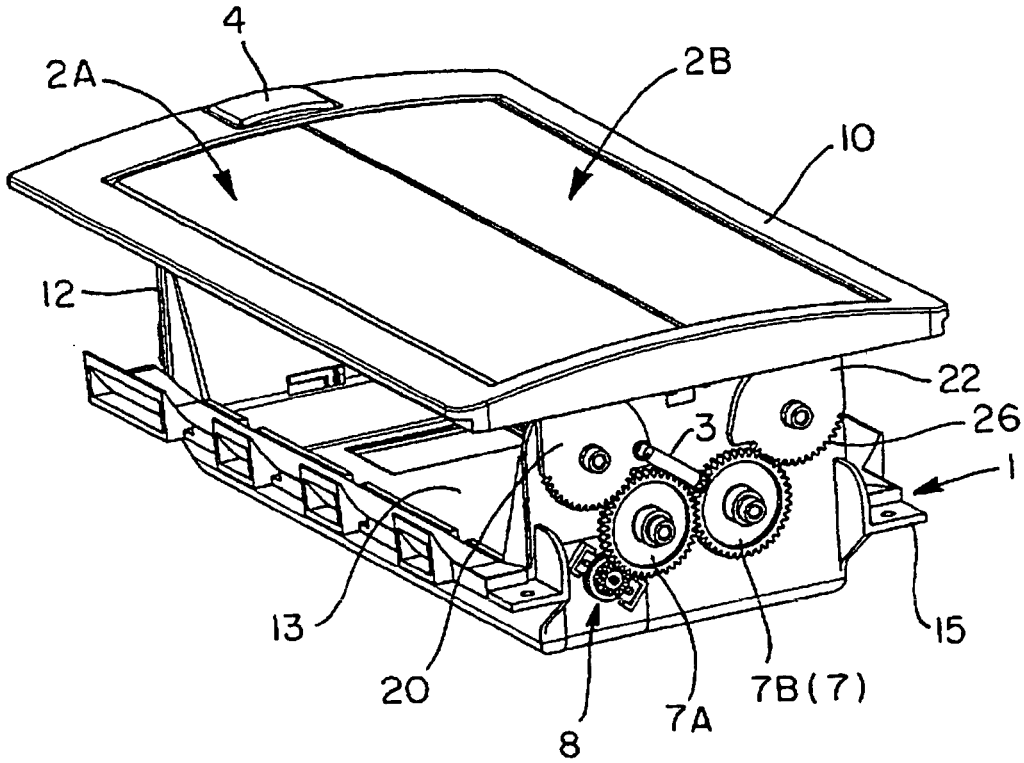

The power transmitting means 7, as shown in FIGS. 2(*a*) and 2(*b*) and FIG. 3(*b*), comprises two mutually engaging idle gears 7A and 7B positioned on the front wall 11 of the main body 1 and respectively being pivotally supported by means of shafts 27 or the like between the front arm part 20 of the cover body 2A and the front arm part 22 of the cover body 2B. The idle gears 7A and 7B have gear shapes which engage the corresponding gear parts 26. In this example, the gear part 26 of the front arm part 20 of the cover body 2A engages the idle gear 7A, and the gear part 26 of the front arm part 22 of the cover body 2B engages the idle gear 7B. Therefore, with the power transmitting means 7, when the cover body 2A is rotated toward the direction of the open position with the shaft 24 as fulcrum, by each engagement previously noted, the cover body 2B is rotated toward the direction of the open position in synchronization with the cover body 2A with the shaft 24 as fulcrum.

The coil spring 3 always forces the cover body 2A toward the direction of the closed position, and one end side is fixed by means of a screw 29 or the like to the arm part 20 of the cover body 2A, and the other end side is fixed by means of the screw 29 or the like to the idle gear 7B engaging the cover body 2B. In the single cover mode shown in FIGS. 8(*a*) and 8(*b*), one end side of the coil spring 3 is fixed by means of the screw 29 or the like to the arm part 20 of the cover body 2, and the other end side is fixed by means of the screw 29 or the like to the corresponding part of the main body 1. In the divided cover mode, as is clear from a comparison between FIGS. 2(*a*) and 2(*b*) and FIGS. 8(*a*) and 8(*b*), even if the coil spring has the same force, because the other end side is changed in position by the idle gear 7B, the spring pressure or force can be adjusted in a multifaceted manner.

The damper means 8 is formed of a rotary-type oil damper or the like, and has an output shaft which is subject to resistance of a working fluid such as oil filled inside a main body 8*a*, and a rotating gear 8*b* installed on that output shaft. Also, the damper means 8 damps the rotational speed of the cover body 2A and prevents sudden rotation of the cover body 2A, with the rotating gear 8*b* engaging the idle gear 7A in a state in which the main body 8*a* is installed on the front wall 11 of the main body 1. In this case, the cover body 2B is damped by means of the idle gear 7B engaging the idle gear 7A. In the single cover mode shown in FIGS. 8(*a*) and 8(*b*), the rotating gear 8*b* of the damper means 8 engages the gear part 26 of the arm part 20 of the cover body 2.

On the other hand, the operating button 4 is placed in the recessed part 10*a* of the border member 10, and the switching means 5 and the latch means 6 are placed using the bracket 9 provided on the rear wall. 12 of the main body. As shown in FIG. 5 and FIGS. 6(*a*) and 6(*b*), the button 4 has a roughly rectangular plate shape and a cylindrical part 4*a* protruding from the lower surface, and is linked to slide freely on the movable body 30 by means of the cylindrical part 4*a*. The movable body 30 is roughly L shaped, and has a shaft 31*a* protruding from the upper surface of a vertical part 31, and a roller 33*b* attached to rotate freely by means of a pin 33*a* on the front end of a horizontal part 32. Also, the movable body 30 is linked to the button 4 in a state in which the shaft 31*a* is inserted inside the cylindrical part 4*a*. In this case, the button 4 is always forced up to a fixed height on the movable body 30 by a spring member 34 placed around the cylindrical part 4*a*. In other words, the upper end of the spring member 34 is fixed on the side of the cylindrical part 4*a* and the lower end is fixed on the side of the shaft 31*a* or the vertical part 31. After the button 4 is pushed down with a finger and the finger is released, the button 4 is returned by force to the original height position.

As shown in FIG. 5, the bracket 9 has integrally a recessed receiving part 9*a* which overlaps with the recessed part 10*a* provided on the upper side of the main body for placing the operating button 4; a frame part 9*b* which is provided beneath the recessed receiving part 9*a* for guiding the vertical part 31 of the movable body 30 inserted therein to slide freely; a latch holding part 9*c* which is provided beneath the main body; a hole part 9*d* which is provided in the middle part of the main body for supporting a cylinder; and tab parts 9*e* and 9*f* which are protruding from the front side of the receiving part 9*a* and on both sides of the main body. Also, the bracket 9 is installed on the rear wall 12 of the main body by coupling the tab part 9*e* to the attachment part 16 of the main body 1 and fixing the corresponding tab parts 9*f* to the attachment parts 17 of the main body 1 by screws or the like.

In the installation, the movable body 30 is placed in a state in which the vertical part 31 is inserted into the frame part 9*b*, and the latch means 6 is attached and held on the holding part 9*c*. After that, the shaft 50 is passed through the pass-through hole of the rear wall 12 from inside the main body 1 and is made to stick outwardly. The shaft 50, as shown in FIGS. 6(*a*) and 6(*b*), is pivotally supported in a state sequentially passing through the acceleration gear 45, gear mechanism 40, and cam 35 constituting the switching means 5 on the shaft axis. A front end (not illustrated, formed as a male screw) is inserted in a cylindrical part 38 of the cam 35 to be described later, and the front end is coupled to a nut 39 inside the cylindrical part 38 to prevent slipping off. Symbol 50*a* is a flange part or head part on the base of the shaft.

The switching means 5, as shown in FIG. 6(*b*), is constituted such that the cam 35 rotates toward the direction of the arrow by means of the movable body 30 by the pushing force of the button 4, and the acceleration gear 45 rotates toward the direction of the arrow in linkage with the rotation of the cam 35. In this example, the gear mechanism 40 is interposed between the cam 35 and the acceleration gear 45, so that the pushing force of the button 4 does not become excessively great.

The cam 35 has integrally a main body 36 having a shaft hole for inserting a shaft therethrough, and a comparatively long arm part 37 which is made to protrude toward one side of the main body 36. On the inner surface 36*a* of the main body 36, a linkage part not illustrated is provided, and a holder 41 is directly connected using the linkage part. A cylindrical part 38 is protruding from the outer surface 36*b* for inserting a nut 39. The cylindrical part 38 is pivotally supported in a state being inserted into the hole part 9*d* of the bracket 9. The front end 37*a* of the arm part 37 is bent upwardly, and an upper surface extending from the front of the front end 37*a* to the main body 36 is set on a pressing surface 37*b* which contacts the roller 33*b* of the movable body 30.

The acceleration gear 45 has integrally a main body 46 having a shaft hole and a gear part 47 which is formed on a part of the main body 46, and on the outer surface side of the main body 46, a flat gear 48 is fixed coaxially with the shaft hole. The gear 47 has a tooth shape which engages the gear part 25 of the cover body 2A or the cover body 2. Also, the gear part 47 is provided on a tongue-shaped part protruding from the main body 46 by a prescribed length. Accordingly, when the main body 46 is pivotally supported on the shaft 50 and is rotated by means of the cam 35 and the like, the acceleration gear 45 accelerates the rotational speed of the gear part 47 over the gear part 25 by the amount that it is moved away from the shaft hole or the shaft 50.

The gear mechanism 40 is formed of a holder 41 having plural small gears 42 (pinions) pivotally supported on a concentric circle; an inner gear 43 inserted in the holder 41 on the inner diameter and having inner teeth 44 engaging the small gears 42; and a flat gear 48 which is provided on the side of the acceleration gear 45. The holder 41 is roughly donut shaped, and the plural small gears 42 are assembled in equally spaced locations on the perimeter. Each small gear 42 is made to protrude out somewhat from the outer diameter and inner diameter of the holder 41. Also, when the holder 41 is placed from a state being linked to the inner surface 36*a* of the cam 35 to the inner diameter of the inner gear 43, each small gear 42 engages the inner teeth 44 of the inner gear 43. Also, when the flat gear 48 fixed to the acceleration gear 45 is inserted into the holder 41 from the inner diameter of the inner gear 43, each small gear 42 engages the flat gear 48.

(Operation) Next, an operation of the cover opening and closing mechanism is explained with reference to FIGS. 1(*a*) and 1(*b*) and FIGS. 2(*a*) and 2(*b*). FIG. 1(*a*) and FIG. 2(*a*) show the closed position of the cover bodies. In the closed position, the cover bodies 2A and 2B are held by a strength corresponding to the spring pressure of the coil spring 3 provided between the arm part 20 of the cover body 2A and the idle gear 27 engaging with the gear part 26 of the cover body 2B. Also, the button 4 is in an upper initial position by the force of the spring member 34, and the roller 33 of the movable body 30 lightly contacts the pressing surface 37*b* of the cam 35. In the case of switching the cover bodies 2A and 2B to the open position, the button 4 is pressed toward the direction of the arrow in FIG. 1(*a*) by a finger or the like. Accordingly, the movable body 30 moves toward the pushing direction of the button 4. The cam 35 is rotated counterclockwise by means of the roller 33 by the movement of the movable body 30. When the cam 35 is rotated, the acceleration gear 45 is rotated toward the same direction as the cam 35 by means of the gear mechanism 40. The cover body 2A, with the rotation of that acceleration gear 45, is rotated up to the open position shown in FIG. 1(*b*) and FIG. 2(*b*) by means of the engagement between the gear part 47 and the gear part 25. In the course of the rotation, the force of the coil spring 3 is increased, that is, the spring is charged. Also, the rotational force of the cover body 2A is transmitted to the other cover body 2B by the power transmitting means 7, so that the cover body 2B is rotated to the open position in synchronization. At the same time, the striker 49 is engaged (locked) the latch means 6 along the rotation of the acceleration gear 45. Accordingly, the cover bodies 2A and 2B are held in the open position against the force of the coil spring 3.

Also, in the case of switching the cover bodies 2A and 2B to the closed position, the button 4 is pushed toward the direction as the arrow in FIG. 1(*b*) same as the direction of switching to the open position, and the pushing force is released. Accordingly, the cover bodies 2A and 2B move from the position of the solid line in the drawing to the position of the hidden line by means of the movable body 30, the cam 35, the gear mechanism 40, and the acceleration gear 45 by the pushing force. Also, the striker 49 is released from the locked state in a state of once entering deeply the housing of the latch means 6. After that (after releasing the pushing force), the cover bodies 2A and 2B are again switched to rotate toward the closed position by the force of the coil spring 3 as described previously.

As described above, the cover opening and closing mechanism of the present invention can eliminate the problems as mentioned as the objects. It is possible to assuredly eliminate the risk that the cover body might be switched to the open position unexpectedly by an impact load caused by a collision accident or the like. It is possible to improve the operability of opening and closing, and the placement space and the external appearance characteristics. Of course, the present invention is not limited to the above-mentioned examples, and the detailed parts of each means are capable of numerous modifications. As one example, as the switching means 5, it is possible to constitute it with just the cam 35 and the acceleration gear 45. However, it is preferable to reduce the pushing load applied to the button 4 and improve the operability when the cover body is switched from the closed position to the open position by the push operation of the button 4 by interposing the gear mechanism 40 between the cam 35 and the acceleration gear 45 as in the examples.

The disclosure of Japanese Patent Application No. 2004-045312, filed on Feb. 20, 2004, is incorporated in the application.

While the invention has been explained with reference to the specific embodiments of the invention, the explanation is illustrative and the invention is limited only by the appended claims.

What is claimed is:

1. A cover opening and closing mechanism for switching a cover body between a closed position and an open position for an opening of a main body, comprising:

forcing means for always urging the cover body toward the closed position, one push button provided on the main body, a gear part adapted to be provided on the cover body, switching means having a cam facing the push button to be operated by the push button, an acceleration gear engaging the gear part provided on the cover body and engaging the cam, and a striker, said switching means switching the cover body from the closed position to the open position against a force of the forcing means through the cam and acceleration gear when the button is pushed, and latch means for locking the striker in the open position of the cover body and releasing the lock when the button is pushed.

2. A cover opening and closing mechanism according to claim 1, further comprising power transmitting means for switching another cover body associated with said cover body between an open position and a closed position in linkage with said cover body.

3. A cover opening and closing mechanism according to claim 2, wherein said power transmitting means has a pair of idle gears interposed between said cover body and said another cover body, said forcing means including a coil spring having two ends, one of said two ends being fixed to said cover body and the other of the two ends being fixed to one of the pair of the idle gears engaging the another cover body.

4. A cover opening and closing mechanism according to claim 1, wherein said switching means further includes a movable body contacting the one push button to be moved vertically and engaging the cam for rotating the cam.

5. A cover opening and closing mechanism according to claim 4, wherein said acceleration gear has a gear portion at one side engaging the gear part of the cover body, and said striker at another portion thereof.

6. A cover opening and closing mechanism according to claim 5, wherein said switching means further includes a force amplifying gear mechanism interposed between the cam and the acceleration gear.

7. A cover opening and closing mechanism according to claim 1, wherein said latch means includes a push-push locking mechanism for locking the striker by a first push operation of the button and releasing the lock by a subsequent push operation of the button in a same direction.

8. A cover opening and closing mechanism according to claim 1, further comprising damper means for damping an opening and closing speed of the cover body.

* * * * *